US005725155A

United States Patent [19]

Grunenberg et al.

[11] Patent Number: 5,725,155

[45] Date of Patent: Mar. 10, 1998

[54] AEROSOL-FOAM DISPENSER HEAD

[75] Inventors: Bernhard Grunenberg, Langenfeld; Hans Dieter Harbort, Meddewade; Lutz Maske, Elmenhorst, all of Germany

[73] Assignee: Henkel Kommanditgesellschaft auf Aktien, Duesseldorf, Germany

[21] Appl. No.: 556,999

[22] PCT Filed: Jun. 7, 1994

[86] PCT No.: PCT/EP94/01853

§ 371 Date: Feb. 2, 1996

§ 102(e) Date: Feb. 2, 1996

[87] PCT Pub. No.: WO94/28759

PCT Pub. Date: Dec. 22, 1994

[30] Foreign Application Priority Data

Jun. 11, 1993 [DE] Germany ..... 9308745 U

[51] Int. Cl.[6] ..... B05B 7/30

[52] U.S. Cl. ..... 239/343; 239/428.5; 239/432

[58] Field of Search ..... 239/343, 337, 239/373, 428.5, 432, 429

[56] References Cited

U.S. PATENT DOCUMENTS

| | | | |
|---|---|---|---|
| 1,457,895 | 6/1923 | Campanello | 239/343 X |
| 2,585,092 | 2/1952 | Conto | 239/343 X |
| 2,624,622 | 1/1953 | Holte | 239/343 |
| 2,783,091 | 2/1957 | Haldy | 299/90 |
| 3,428,985 | 2/1969 | Boyd | 239/343 X |
| 3,709,437 | 1/1973 | Wright | 239/343 |
| 3,946,947 | 3/1976 | Schneider | 239/401 |
| 3,985,271 | 10/1976 | Gardner | 239/343 X |
| 4,219,159 | 8/1980 | Wesner | 239/343 |
| 4,324,365 | 4/1982 | Howarth | 239/424 |
| 4,646,973 | 3/1987 | Focaracci | 239/428.5 |
| 4,925,106 | 5/1990 | Maas et al. | 239/343 X |
| 5,033,654 | 7/1991 | Bennet | 222/190 |
| 5,054,688 | 10/1991 | Grindley | 239/407 |
| 5,085,371 | 2/1992 | Paige | 239/343 |
| 5,156,307 | 10/1992 | Callahan et al. | 239/343 X |
| 5,340,031 | 8/1994 | Neuhaus et al. | 239/343 |

FOREIGN PATENT DOCUMENTS

| | | | |
|---|---|---|---|
| 0530570 | 3/1993 | European Pat. Off. . | |
| 2925528 | 1/1985 | Germany . | |
| 3644237 | 6/1987 | Germany . | |
| 8712658 | 11/1987 | Germany . | |
| 4224910 | 6/1994 | Germany . | |
| 638697 | 10/1983 | Switzerland . | |
| 415248 | 8/1934 | United Kingdom . | |
| 2024049 | 1/1980 | United Kingdom . | |
| 93/23175 | 11/1993 | WIPO | 239/343 |

*Primary Examiner*—Kevin Weldon

*Attorney, Agent, or Firm*—Ernest G. Szoke; Wayne C. Jaeschke; Kenneth Watov

[57] ABSTRACT

An aerosol-foam dispenser head is mounted on a container which holds a solution of an active substance and an insoluble, gaseous propellant, and which opens a valve in the container when actuated. The dispenser head has, at the near end of its outlet channel, a throttled aperture with a relatively small flow cross section. Located in the wall of the channel, downstream of the aperture is at least one opening connecting with the atmosphere, the cross section of the opening being significantly greater than that of the throttled aperture. Located at the far end of the channel is a fine-mesh grating or screen.

8 Claims, 2 Drawing Sheets

AEROSOL-FOAM DISPENSER HEAD

BACKGROUND 1.0. Field of the Invention

This invention relates to a dispensing head for a foam aerosol.

2.0. Discussion of Related Art

Foam aerosols are used, for example, in the home for cleaning carpets, baths or the like or even in cosmetics for hair and body care. It is known that the active substances for such aerosol foams can be driven out by hydrocarbons and fluorocarbons. Fluorocarbons are being increasingly rejected for environmental reasons. Hydrocarbons are inflammable and are therefore unsafe.

Safe propellants include compressible gases, such as nitrogen or compressed air. Whereas hydrocarbons dissolve in liquid active substances, this is not the case with nitrogen or compressed air. Accordingly, it is difficult with such propellants to keep the pressure sufficiently high to obtain effective spraying as the active substances are consumed. Moreover, it is difficult with such propellants to obtain useful aerosol foams from conventional valve/dispensing head combinations.

It is known from DE 36 44 237 that shaving foams or the like can be produced by a design in which the discharge channel opens into a collecting chamber for the foam behind the valve which closes the pack. The flow of foam is deflected by a deflector before emerging outwards through a wire which forms the end wall of the collecting chamber. The mesh width of the wire is 1 mm or slightly narrower. A dispensing head such as this is also incapable of producing a foam in the required manner with the aid of an insoluble gaseous propellent.

SUMMARY OF THE INVENTION

The problem addressed by the present invention is to provide a dispensing head for a foam aerosol which, even with liquid-insoluble propellent gases, effectively produces aerosol foams and maintains an adequate spraying pressure, even towards the end of dispensing of the active substance.

In the dispensing head according to the invention, the conventional valve for the aerosol pack is followed in the direction of flow by a flow restriction opening of relatively small cross-section. Its cross-section may have a diameter of, for example, 0.2 to 1.5 mm and preferably of the order of 0.6 mm. These diameters depend to a large extent on the properties of the substance. The liquid active substance thus flows through the flow restriction opening at relatively high speed and, from the lateral opening in the wall of the flow passage, entrains outside air which contributes towards the generation of turbulence in and foaming of the active substance. At the end of the passage, the turbulent, air-enriched jet impinges on a fine-mesh wire or sieve so that a compact foam or a flat foam emerges according to the distance to the surface to be sprayed.

In one embodiment of the invention, the axis of the opening is directed obliquely upwards to produce an ejector effect. Several openings or slots are preferably formed at equal peripheral intervals in the wall of the passage. In another embodiment of the invention, these opening(s) is/are preferably positioned immediately after the flow restriction opening. In this zone, the flow rate of the jet of active substance is still at its highest.

At its upper end, the dispenser is normally tubular in shape to form the flow passage repeatedly mentioned in the foregoing. If the openings are situated in the tubular section, foreign particles can also enter the passage through the openings and could adversely affect the function of the dispensing head. In another embodiment of the invention, therefore, a section of the passage comprising the flow restriction opening is connected by several webs peripherally arranged at intervals to the interior of the hat- or cap-like part in which the flow passage is formed. The cap-like section surrounds the valve of the pack on which the dispensing head is mounted and, in addition, is generally at a sufficient distance from the upper side of the pack so that the dispensing head can be pressed down against the pack to actuate the valve. Accordingly, air also has sufficient access to the interior of the cap-like part. The additional openings are thus able to perform their function without any risk of their effectiveness being endangered by foreign particles. The transitional zone from the cap-like part to the flow passage is preferably provided with a conical aperture so that the ejector effect mentioned above is satisfactorily established.

By virtue of the fact that ambient air is used to assist in the foaming of the active substance, the quantity of gaseous propellent can be reduced. Accordingly, in the dispensing head according to the invention, nitrogen or compressed air is still sufficiently available under adequate pressure in the aerosol pack, even when virtually all the active substance has been dispensed.

As already mentioned, the wire or the sieve has a relatively small mesh width. In one embodiment of the invention, its mesh width is preferably less than 0.2 mm.

In another embodiment of the invention, the sieve can be formed in a ring of plastic which is subsequently introduced into a recess at the upper end of the passage section. The integral formation of a sieve with a plastic ring or the like by injection moulding is readily possible by conventional techniques. Alternatively, a sieve or the like can be arranged at the end of a sleeve which can then be fitted like a hat onto a hollow cylindrical projection which delimits the lower part of the flow passage and comprises the opening(s).

BRIEF DESCRIPTION OF THE DRAWINGS

Examples of embodiments of the invention are described in detail in the following with reference to the accompanying drawings, in which like items are identified by the same reference designation, wherein.

DETAILED DESCRIPTION OF THE INVENTION

Figure 1:
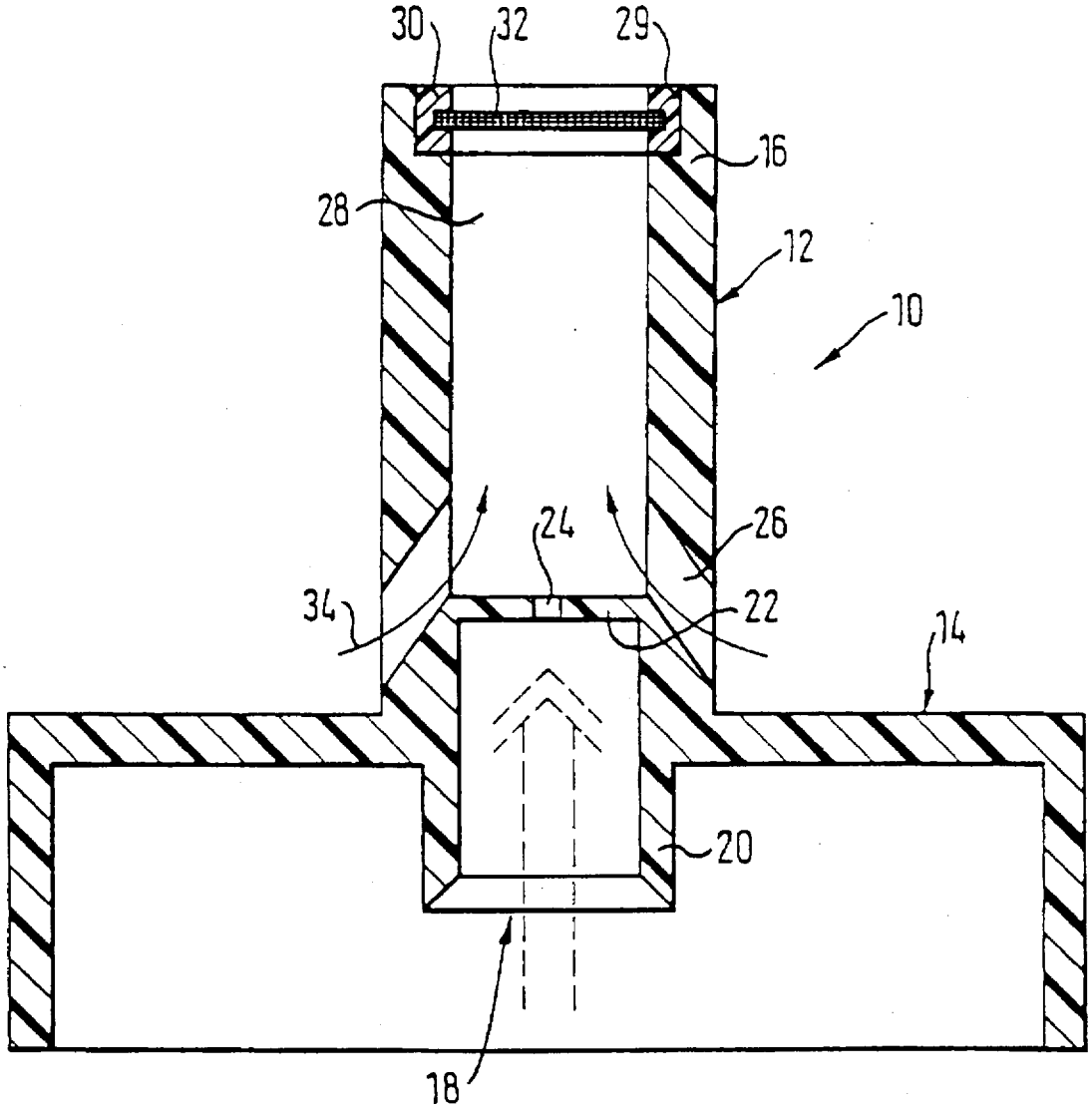
FIG. 1 is a section through a diagrammatically illustrated dispensing head according to the invention.

The illustrated dispensing head 10 comprises a one-piece component 12 of plastic with a lower hat-like section 14 and a sleeve-like upper section 16 (see FIG. 1).

Arranged centrally in the hat-like section 14 is a hollow cylindrical downward projection 20 which co-operates with a valve (not shown) of an aerosol pack on which the dispensing head 10 is mounted. For example, the dispensing head 10 can co-operate with the stem of an aerosol valve, as shown at 18.

Near the cover part of the hat-like section 14, the sleeve-like section 16 is divided by a partition 22 in which a small flow restriction opening 24 is formed. The flow restriction opening has a diameter of, for example, 0.46 mm. Immediately after the partition 22, several openings 26 open into the interior of the passage 28 formed in the sleeve-like section 16. The axes of the openings 26 are directed obliquely upwards.

Provided at the upper end of the sleeve section 16 is a circular recess 28 which accommodates a plastic ring 30 integrally formed with a fine-mesh sieve 32. The sieve has a mesh width of, preferably, 0.2 mm or less and is made of plastic or metal.

The dispensing head dispenses aerosol foams of the type used, for example, for cleaning carpets or baths or even cosmetic products. The corresponding active substance (a surfactant solution) is packed in a conventional aerosol pack and is under the pressure of a water-insoluble propellant gas, such as air or nitrogen, for example. If the aerosol valve is opened by finger actuation of the dispensing head 10, the active substance flows together with air through the relatively narrow flow restriction opening 24 and is thus considerably accelerated. In this way, ambient air is taken in through the ejector-like openings 26, as indicated by the arrow 34. The mixture of active substance and air impinges on the sieve 32 at relatively high speed, the required foam being formed at the sieve 32 openings.

The distance between the sieve 32 and the flow restriction opening 24 can be varied. It is preferred to position the sieve 32 at a minimal distance from the flow restriction opening 24 and the openings 26.

Figure 2:
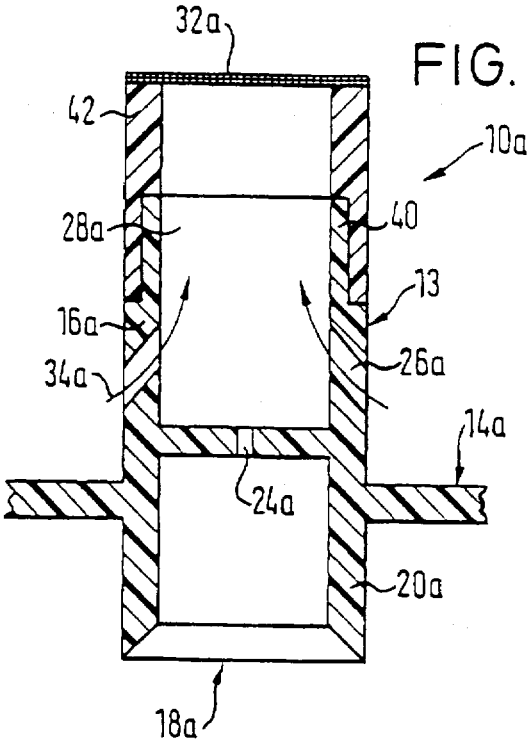
FIG. 2 is a section similar to FIG. 1 with a different design of the upper part of the dispensing head.

In FIG. 2, the same parts as in FIG. 1 are denoted by the same reference numerals accompanied by the index a. The dispensing head **10*a* is in two parts. It comprises a lower part 13 similar in construction to the component 12 in FIG. 1 except for a section 40 of reduced diameter of the tubular or sleeve-like section 16*a*. The section 40 is intended to receive a sleeve 42 with a section of relatively large diameter so that the passage 28*a* has a substantially constant internal diameter. A wire 32*a* is applied to the sleeve 42, for example by bonding or welding. The parts 42,13** can be joined to one another by a press fit or, again, by bonding or welding.

Figure 3:
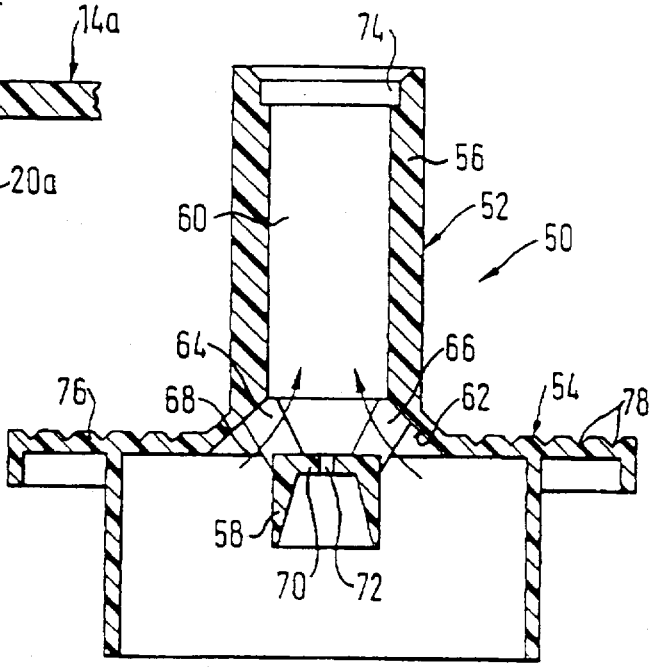
FIG. 3 is a section through another embodiment of the dispensing head according to the invention.

The dispensing head 50 shown in FIG. 3 is similarly a one-piece component 52 made of plastic. It has a lower hat- or cap-like section 54 and an upper sleeve- or tube-like section 56.

Situated in the section 54 is a hollow cylindrical projection 58 which co-operates with a valve (not shown) of an aerosol pack on which the dispensing head 50 is mounted. For example, the projection 58 can co-operate with the stem of an aerosol valve, as already described in conjunction with FIG. 1.

The transition from the interior of the cap-like section 54 to the passage 60 of the tubular section 56 is conical, as shown at 62. The wall of the conical section 62 is formed with four equidistantly arranged webs of which two are shown at 64 and 66. The webs extend outwards to the outer wall of the tubular projection 58 depending from the tubular section 56. Between them, the webs form openings through which air is able to flow in the direction of the arrows 68.

The tubular projection 58 is closed at its upper end by a wall 70 in which is formed a flow restriction opening 72, for example with a diameter of 0.6 mm.

The dispensing head shown in FIG. 3 operates in the same way as that shown in FIG. 1. When active substance flows under pressure through the flow restriction opening 72, air in the cap-like section 54 is entrained and also flows into the passage 60. The wire, which is not shown in FIG. 3, is positioned in an inner recess 74 at the free end of the tubular section 56.

Figure 4:
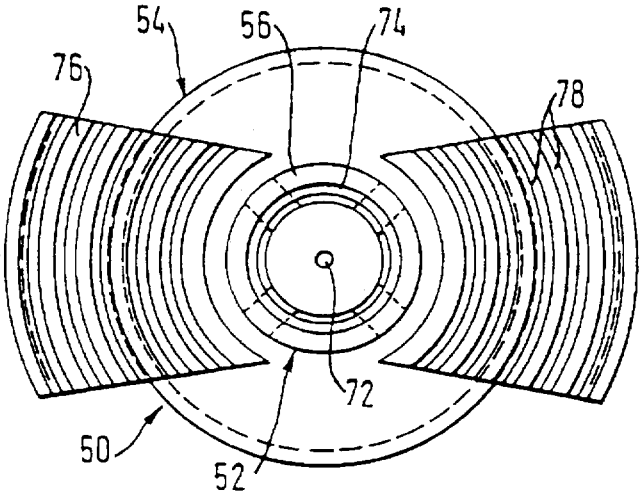
FIG. 4 is a top view of the dispensing head shown in FIG. 1 from above.

As shown in FIG. 4, the outside of the cap-like section 54 is formed with a pair of mutually opposite vanes 76 which are provided on top with grooves of triangular cross-section lying on an arc. The vanes 76 are designed to facilitate gripping of the dispensing head 50, for example with the index and middle fingers, in order to press the dispensing head against the pack and to actuate the aerosol valve (not shown).

What is claimed is:

1. A dispensing head for a foam aerosol, comprising a one piece component for attachment to a pack containing a solution of an active substance, said component including:

a flow channel formed in an elongated first cylinder housing section;

a first opening at an exit end of said flow channel for ejecting foam therefrom;

a second opening at an opposite end of said flow channel, said second opening having a cross-section significantly larger than that of said first opening;

a fine meshed sieve arranged within and transverse to the longitudinal axis of said flow channel proximate to said first opening;

an interior channel section having a top portion located in the plane of said second opening below said flow channel, said interior channel section being configured for receiving a rammer of a valve of said pack containing means for forming an insoluble driver gas, said interior channel section including a throttle third opening concentric with said second opening, said third opening having a relatively small cross-section compared to the diameter of said flow channel in the direction of flow;

a plurality of spaced apart circumferentially arranged struts rigidly connected between an interior portion of said first cylindrical housing section about said second opening and said interior channel section for retaining the latter in position, there being openings between said struts;

a second cylindrical housing section having an interior space of substantially greater diameter than said second opening, said second cylindrical housing section being formed concentric with and immediately below said first cylindrical housing section, and surrounding said interior channel section; and an annular wall section rigidly formed around said second opening for connecting said first and second cylindrical housing sections, together;

whereby insoluble driver gas flowing through said third opening entrains air from the interior of said second cylindrical housing section through the openings between said struts.

2. A dispensing head according to claim 1, wherein a conically tapered passageway is provided in the transition of the cap-shaped section to the flow channel, and wherein the struts are connected to conical walls of said passageway.

3. A dispensing head according to claim 1, wherein four struts are provided.

4. A dispensing head according to claim 1, wherein the throttled said third opening has a diameter of 0.2 to 1.5 mm, approximately 0.6 mm.

5. A dispensing head according to claim 1, wherein the sieve is molded inside a ring made of plastic, which is inserted into a recess at the top end of the interior channel section.

6. A dispensing head according to claim 5, wherein said ring is seated in a pressure-molded seat in the recess.

7. A dispensing head according to claim 1, wherein said sieve is affixed to said exit end of said first cylindrical housing, and radial openings are provided about said throttled third opening.

8. A dispensing head according to any of claim 1, wherein the sieve has a mesh width of less than 0.2 mm.

* * * * *